US005490603A

United States Patent [19]

Davis

[11] Patent Number: 5,490,603

[45] Date of Patent: Feb. 13, 1996

[54] FLUID TANK APPARATUS

[75] Inventor: Thomas R. Davis, Lincoln, Nebr.

[73] Assignee: Snyder Industries, Inc., Lincoln, Nebr.

[21] Appl. No.: 300,970

[22] Filed: Sep. 6, 1994

[51] Int. Cl.[6] ..... B65D 19/00

[52] U.S. Cl. ..... 220/4.12; 220/1.5; 220/401

[58] Field of Search ..... 220/630, 634, 220/635, 1.5, 4.12, 4.13, 401, 408

[56] References Cited

U.S. PATENT DOCUMENTS

| | | | |
|---|---|---|---|
| 2,443,684 | 6/1948 | Lazarus . | |
| 2,457,842 | 1/1949 | Smith et al. | 220/1.5 |
| 2,593,472 | 4/1952 | McGinn . | |
| 2,872,079 | 2/1959 | Moore . | |
| 2,935,205 | 1/1959 | Higgin . | |
| 3,009,674 | 11/1961 | Ingvartsen . | |
| 3,113,690 | 12/1963 | Swenck . | |
| 3,114,339 | 12/1963 | Bayluk . | |
| 3,123,021 | 3/1964 | Evans . | |
| 3,170,415 | 2/1965 | Svilokos . | |
| 3,327,654 | 6/1967 | Duncan et al. . | |
| 3,499,398 | 3/1970 | Murray . | |
| 3,563,184 | 2/1971 | Angelbeck, Jr. . | |
| 3,565,018 | 2/1971 | Jay . | |
| 3,762,343 | 10/1973 | Thacker . | |
| 3,840,141 | 10/1974 | Allom et al. . | |
| 4,648,521 | 3/1987 | Thomas et al. | 220/4.13 X |
| 4,838,443 | 6/1989 | Cripe et al. | 220/1.5 X |
| 4,924,783 | 5/1990 | Weizer et al. . | |
| 5,039,044 | 8/1991 | Sher . | |
| 5,110,000 | 5/1992 | Nichols | 220/1.5 X |
| 5,197,601 | 3/1993 | Sterett | 220/1.5 X |
| 5,201,432 | 4/1993 | Elvin-Jensen | 220/1.5 |
| 5,253,776 | 10/1993 | Decroix et al. | 220/1.5 X |

*Primary Examiner*—Steven M. Pollard

*Attorney, Agent, or Firm*—Hovey, Williams, Timmons & Collins

[57] ABSTRACT

A tank apparatus includes a tank, a base for supporting the tank, and a top protector supported on the base and extending above the tank for permitting a plurality of apparatuses to be stacked on top of one another without transmitting compressive loads on the tanks of underlying apparatuses. The base includes a bottom wall, an understructure depending from the bottom wall for bearing the weight of the base and tank, and a plurality of upstanding hollow columns within which reinforcing members may be provided. The top protector is supported on the columns so that compressive loads exerted on the top protector are transmitted to the base without being transmitted through the tank. Thus, the load bearing capacity of the apparatus is determined by the strength and rigidity of the base and reinforcing members independent of the tank construction.

10 Claims, 2 Drawing Sheets

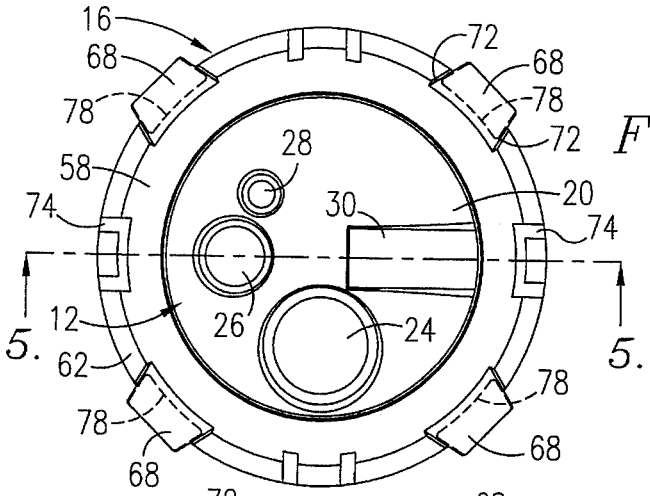
FIG. 4.
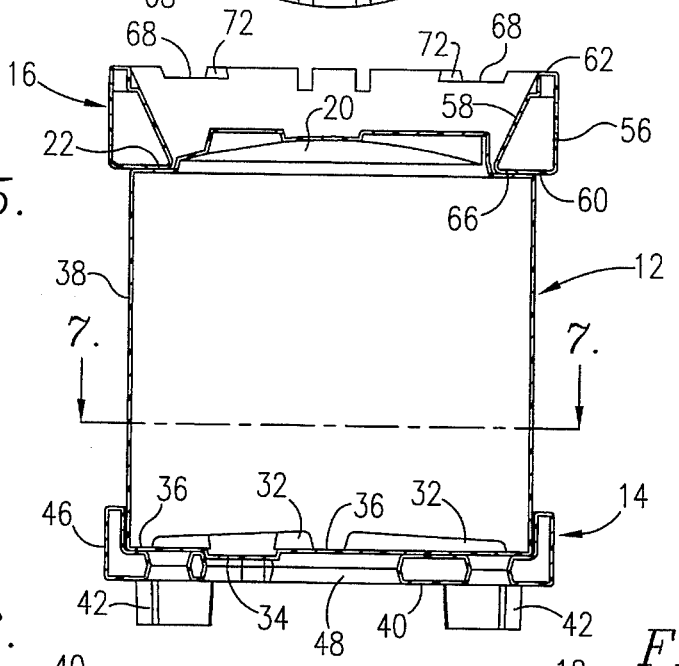
FIG. 5.
FIG. 6.
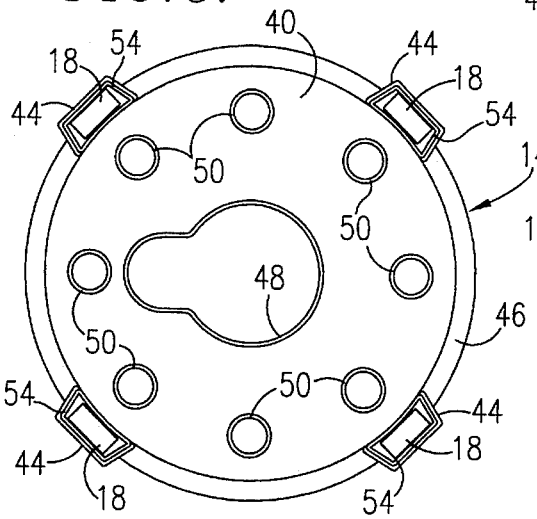
FIG. 7.
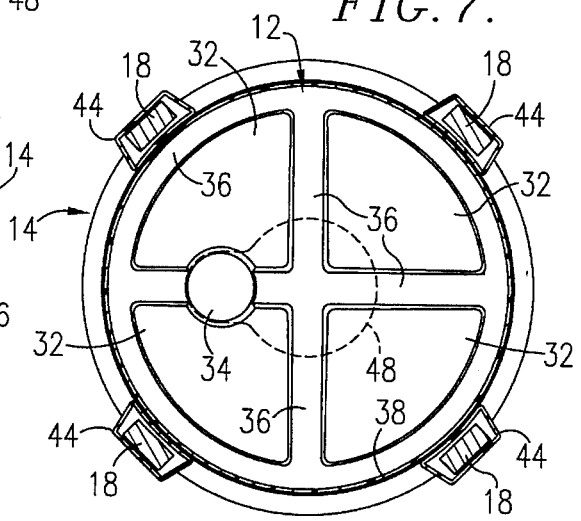

FLUID TANK APPARATUS

BACKGROUND OF THE INVENTION

1. Field of the Invention

The present invention relates generally to fluid containers and, more particularly, to a fluid tank apparatus having a construction which permits a plurality of the apparatuses to be stacked on top of one another for storage or transportation.

2. Discussion of the Prior Art

It is known to provide a fluid container of a construction adapted to permit a plurality of the containers to be stacked vertically for storage. Typically, such containers include a specially designed shape and are formed with walls having a strong, rigid construction so that when several of the filled containers are stacked on one another, the container on the bottom of the stack has the load bearing capacity to support the total weight of the filled containers on top of it.

A problem encountered with the use of such conventional containers resides in the weakening of the load bearing capacity of the containers that occurs when they are dented or damaged during handling. For example, when a container having a given load bearing capacity is damaged even slightly by a fork lift or other piece of handling equipment, the ability of the container to resist buckling may be drastically reduced. Thus, the load bearing capacity of these containers is easily frustrated, effecting the possible collapse and failure of the lower containers of a stack, and resulting in toppling of the entire stack.

OBJECTS AND SUMMARY OF THE INVENTION

It is an object of the present invention to provide a fluid tank apparatus having a tank and a means for decoupling the tank from the weight of other apparatuses stacked on top of it.

Another object of the invention is to provide such an apparatus, wherein the tank is protected against physical denting or other damage, while being accessible for use.

The invention also provides an apparatus having a base with hollow tubular support columns adapted to receive rigid reinforcing members that support the weight of additional apparatuses stacked on top of the base. The support columns define sleeves for the reinforcing members and protect the members from corrosion and wear.

In accordance with these and other objects evident from the following description of a preferred embodiment, a fluid tank apparatus comprises a tank, a base for supporting the tank, and a top protector. The base includes a bottom wall on which the tank is supported, a plurality of hollow columns extending upward from the bottom wall, and a plurality of feet aligned vertically with the columns and depending from the bottom wall. The top protector extends above the tank for protecting it from exposure to compressive loads exerted on the apparatus from above, and is supported on the reinforcing members for transmitting compressive loads exerted on the top protector to the base without transmitting the load through the tank.

By providing a construction in accordance with the present invention, numerous advantages are obtained. For example, by providing a tank supported between a base and top protector as described, the tank is protected both from physical contact and from compressive loading such that the tank is able to be easily transported and stored without being crushed.

In addition, the construction results in a strong, stackable apparatus that allows unrestricted access to the tank for use of the fluid contained therein.

BRIEF DESCRIPTION OF THE DRAWING FIGURES

The preferred embodiment of the invention is described in detail below, with reference to the attached drawing figures, wherein:

FIG. 4 is a top plan view of the apparatus;

FIG. 5 is a sectional view taken along line 5—5 of FIG. 4;

FIG. 6 is a top plan view of a base of the apparatus; and

FIG. 7 is a sectional view taken along line 7—7 of FIG. 5.

DETAILED DESCRIPTION OF THE PREFERRED EMBODIMENT

Figure 1:
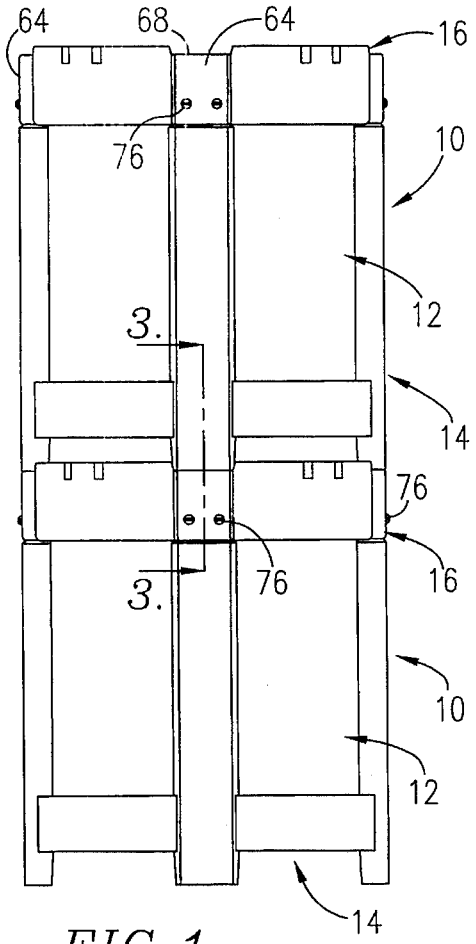
FIG. 1 is a front elevational view of a pair of fluid tank apparatuses constructed in accordance with the preferred embodiment, illustrating the apparatuses stacked on top of one another.

A pair of fluid tank apparatuses 10 are illustrated in FIG. 1, with one of the apparatuses stacked on top of the other. Each is identical to the other, and is constructed to rest on the ground or to nest on top of another apparatus of the same construction, and to receive yet another apparatus on top of it.

Figure 2:
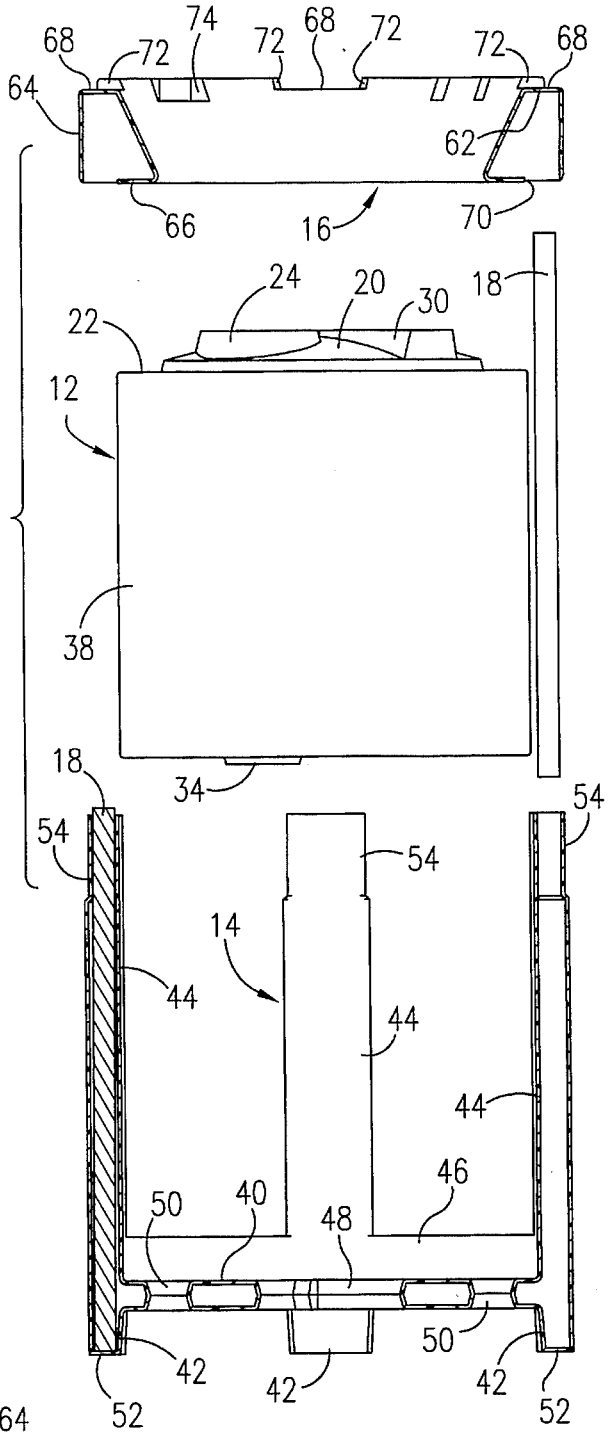
FIG. 2 is an exploded front elevational view, partially in section, of a fluid tank apparatus.

A single fluid tank apparatus is shown in FIG. 2, and broadly includes a tank 12, a base 14, and a top protector 16. In addition, a number of reinforcing members 18 are provided which are adapted to be received in the base in a manner described below.

The tank 12 is formed of a thermoplastic resin or other moldable material, and is preferably formed by a rotation molding technique which produces a closed, hollow tank having a uniform wall thickness. The tank includes a top end presenting a domed center region 20 and a flat circumferential edge region 22. As shown in FIG. 4, the domed region 20 includes upstanding, flattened areas 24, 26, 28, 30 adapted respectively for use as a fill opening, an outlet opening, a vent opening, and a pump platform for supporting a fluid pump that may be used to dispense fluid from the container during use. Although the openings 24, 26, 28 are closed at formation of the tank, they may be selectively opened by cutting through the material covering them.

As shown in FIG. 7, a bottom end of the tank opposes the top end, and includes a generally flat bottom wall and four pie-shaped punts 32 which extend upward from the bottom wall into the tank, as shown in FIG. 5. In addition, the bottom wall is formed with a well or sump 34 that depends from the bottom wall. Returning to FIG. 7, the sump 34 is positioned between two of the punts 32 and is offset from the center of the bottom wall by a short distance. A plurality of channels 36 are defined by the bottom wall between and around the punts 32, and communicate with the sump so that fluid may be completely drained from the tank, if desired.

A cylindrical side wall 38 of the tank extends between and connects the top and bottom ends thereof, as shown in FIG. 5, and is of the same thickness as the top and bottom walls. The side wall defines the diameter of the tank, and is of a height designed to fit between the base and top protector, as described below.

The base 14 is illustrated in FIG. 2, and is formed of a thermoplastic resin or other suitable material. The base includes a bottom wall 40, an understructure 42 depending from the bottom wall for supporting the base on the ground, a plurality of upstanding columns 44, and a side wall 46 extending around the bottom wall.

The bottom wall 40 of the base is a hollow, circular wall, and includes a central, key-shaped passage 48, and a plurality of smaller passages 50 disposed around the central passage and spaced equidistant from one another, as shown in FIG. 6. The central passage 48 includes a central circular portion and a radially extending side portion, and the side portion is positioned for alignment with the sump 34 when the tank is positioned on the base in a particular, desired orientation, as shown in FIG. 7. As shown in FIG. 2, the smaller passages extend through the bottom wall to strengthen the wall and to space the upper and lower wall surfaces from one another by a uniform distance across the entire area of the wall.

The understructure 42 of the base includes four feet which depend from the bottom wall at equally spaced locations around the circumference of the bottom wall. Each foot is hollow, and includes a generally trapezoidal cross-sectional shape presenting radially spaced inner and outer walls, and a pair of side walls that are tapered toward one another in a radially outward direction. In addition, each foot presents a bottom wall 52 adapted to rest on the ground or on an underlying apparatus.

The feet 42 are formed in alignment with the columns 44, each of which are also of generally trapezoidal cross-sectional shape, presenting radially spaced inner and outer walls, and a pair of side walls that are tapered radially outward toward one another. The tops of the columns are open, and the columns and feet together define spaces within which the reinforcing members 18 are received such that the reinforcing members extend from the bottom walls 52 of the feet 42 through the tops of the columns 44. Preferably, the reinforcing members 18 are lengths of two-by-four lumber or the like, selected to increase the compressive load bearing capacity of the columns, and to decrease the likelihood that the columns will buckle during use.

The upper end of each column includes a stepped down end portion 54 of reduced size relative to the remainder of the column, the end portions being adapted for connection to the top protector 16. In addition, the inner wall of each column is radiused and the distance between the inner walls of diametrically opposed columns is only slightly greater than the diameter of the tank so that the tank is retained by the columns in place on the base during use.

The bottom wall 40 extends radially beyond the inner walls of the feet 42 and columns 44, and the side wall 46 extends around the circumferential edge of the bottom wall. The side wall 46 extends upward from the bottom wall by a short distance, e.g. 1–3 inches, sufficient to support the tank in place on the base.

The top protector 16 is formed in the shape of a hollow annular ring having an outer diameter generally equal to the diameter of the bottom and side walls of the base. As shown in FIG. 5, the protector includes a vertical outer wall 56, an inner wall 58 spaced radially from the outer wall and being angled downward and inward, and generally horizontally extending bottom and top walls 60, 62 spaced vertically from one another. As shown in FIG. 2, the outer wall of the protector extends radially outward at four locations 64 spaced equidistant from one another around the circumference of the protector. As with the base and tank, the top protector is formed of a thermoplastic resin or other suitable, moldable material by a rotation molding process or the like.

The bottom wall 60 of the protector is provided with four holes 70 at the large diameter locations 64 of the side wall, which define recesses in the top protector adapted to receive the top end sections 54 of the columns 44. The recesses are aligned radially and circumferentially with the columns. The bottom wall 60 also defines an inner circumferential edge region 66, as shown in FIG. 5, and having a diameter corresponding to the diameter of the flat circumferential edge region 22 of the tank 12 so that when the top protector is positioned over the tank, the edge region 66 of the top protector overlies the edge region 22 of the tank and retains the tank in the desired orientation on the base. However, the top protector does not transmit any significant compressive load to the tank, even when such loads are applied to the top of the apparatus.

As shown in FIG. 2, the top wall of the protector is provided with depressions 68 aligned with the holes 70 in the bottom wall. As illustrated in FIG. 4, these depressions 68 each present a flat, horizontally extending support surface adapted to receive a foot of another similar apparatus that is stacked on top of the first apparatus. In addition, each depression is generally trapezoidal in shape, and presents a pair of generally vertically extending side walls 72 that are tapered radially outward toward one another in a direction corresponding to the direction of taper of the side walls of the feet. Thus, when the base of a second apparatus is placed on top of the top protector of a first apparatus, the feet rest in the depressions of the lower top protector, as indicated by the dotted lines in FIG. 4, and the upper apparatus nests on the lower one such that relative lateral movement between the apparatuses is prevented.

The top protector also includes opposed notches 74 in the top wall for permitting a rope or other tie-down to be pulled across the top of the apparatus and fastened to a pallet or the like to hold the apparatus in place.

Turning to FIG. 2, once each of the parts of the apparatus are formed, and recesses are made in the top ends of the columns and in the bottom wall of the top protector, the apparatus is assembled. The tank 12 is first positioned on the base 14 with the sump 34 located in the offset portion of the central passage 48 in the bottom wall of the base. The tank is retained in this position by the sides of the key-shaped passage, by the side wall 46, and by the columns 44 of the base which extend upward along the side wall of the tank.

Figure 3:
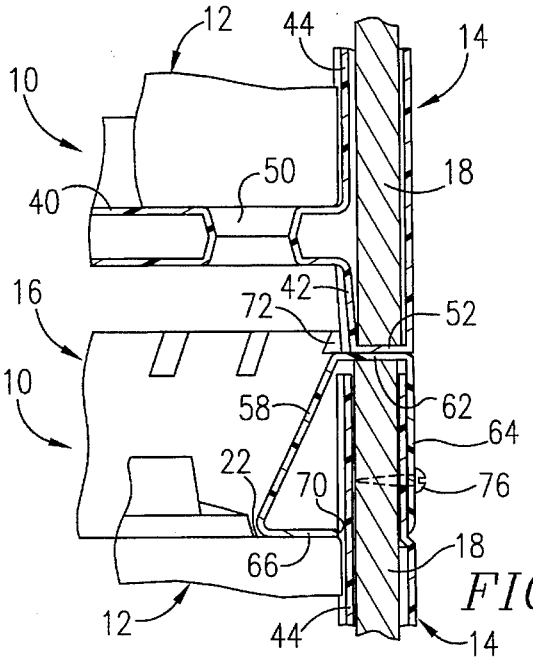
FIG. 3 is a fragmentary sectional view taken along line 3—3 of FIG. 1.

Thereafter, the reinforcing members 18, having a length about equal to or slightly greater than the height of the base, are inserted into the columns, and the top protector is placed down onto the columns and tank, with the recesses in the top protector receiving the columns. If desired, as shown in FIG. 3, threaded screw fasteners 76 may be used to secure the top protector in place on the base so that the entire apparatus is held together as a unit for handling and use. In this manner, handling of the apparatus is simplified.

When the top protector is received on the base, the reinforcing members extend completely through the top protector and engage the top wall 62 of the protector at the depressions 68. Likewise, the reinforcing members extend downward beyond the bottom wall of the base, and engage the bottom walls 52 of the feet. Thus, each reinforcing member 18 extends the complete height of the apparatus between the top wall of the top protector and the bottom walls of the feet.

By providing this construction, each apparatus supports the reinforcing members in an orientation which permits multiple apparatuses to be stacked on top of one another, as shown in FIG. 1, with the reinforcing members of the apparatuses aligned with each other. Thus, all compressive loads carried by the apparatuses are borne by the reinforcing members, and are transferred to any underlying apparatus, or to the ground, by the reinforcing members without transferring load through the tank. The tanks support only the pressure of the fluid and of any hardware mounted on the top end of the tank, and are decoupled from all other loads exerted on the apparatus from above.

Although the present invention has been described with reference to the preferred embodiment illustrated in the attached drawing figures, it is noted that substitutions may be made and equivalents employed herein without departing from the scope of the invention as recited in the claims.

What is claimed is:

1. A tank apparatus comprising:

a tank including top and bottom ends and a side wall extending between the ends, the side wall defining a tank diameter;

a hollow unitary base for supporting the tank, the base including a bottom wall on which the tank is supported, a plurality of hollow columns extending upward from the bottom wall, and plurality of hollow feet aligned vertically with the columns and depending from the bottom wall, the columns being spaced from one another to define a tank receiving area having a diameter slightly larger than the tank diameter; and a top protector extending above the tank for protecting the tank from exposure to loads exerted on the apparatus from above, the top protector being supported on the columns for transmitting loads exerted on the top protector to the base without transmitting the load through the tank.

2. An apparatus as recited in claim 1, wherein the bottom end of the tank is provided with a depending sump and the top end is provided with a central domed region and a circumferential flat edge region.

3. An apparatus as recited in claim 2, wherein the top protector is hollow, including a bottom wall positioned over the circumferential edge region of the tank and extending radially outward beyond the tank, a top wall spaced from the bottom wall, and a plurality of recesses for receiving the columns.

4. An apparatus as recited in claim 3, wherein the top wall of the protector includes a plurality of depressions of a shape corresponding to the shape of the feet of the base so that if a pair of the apparatuses are stacked one on top of the other, the feet of one of the apparatuses will nest on the top protector of the other apparatus.

5. An apparatus as recited in claim 4, wherein the depressions in the top wall of the protector are aligned vertically with the recesses in the bottom wall of the protector.

6. An apparatus as recited in claim 2, wherein the bottom wall of the base includes an opening through which the sump of the tank extends so that the sump is accessible from beneath the base and the tank is retained in a particular orientation on the base.

7. An apparatus as recited in claim 2, wherein the base includes a hollow upstanding side wall extending around the tank for supporting the tank on the base.

8. An apparatus as recited in claim 1, wherein the side wall of the tank is cylindrical, each column including an inner wall facing the side wall of the tank, the inner walls being radiused to present a shape corresponding to the shape of the side wall of the tank.

9. An apparatus as recited in claim 1, further comprising a plurality of reinforcing members sized for receipt in the columns to reinforce the columns and increase the load bearing capacity of the base.

10. A tank apparatus comprising:

a tank having bottom and top ends and a side wall extending between the bottom and top ends;

a base for supporting the tank, the base including a bottom wall on which the tank is supported, an understructure depending from the bottom wall for bearing the weight of the base and tank, and a plurality of hollow columns extending upward from the bottom wall along the side wall of the tank;

a plurality of reinforcing members sized for receipt in the columns to reinforce the columns and increase the load bearing capacity of the base; and a top protector supported on the columns of the base above the top of the tank for covering the reinforcing members and protecting the tank from exposure to compressive loads exerted on the apparatus from above, the top protector presenting a central opening through which access to the top of the tank is permitted.

* * * * *